United States Patent [19]

Karlsberg

[11] Patent Number: 4,513,842

[45] Date of Patent: Apr. 30, 1985

[54] CREDIT CARD HAIR COMB

[76] Inventor: Jerry J. Karlsberg, 4020 76th SE., Mercer Island, Wash. 98040

[21] Appl. No.: 417,129

[22] Filed: Sep. 13, 1982

[51] Int. Cl.[3] ..... A45D 24/00

[52] U.S. Cl. ..... 132/11 R

[58] Field of Search ..... 132/11 R, 101, 129, 132/147, 149

[56] References Cited

U.S. PATENT DOCUMENTS

| | | | |
|---|---|---|---|
| D. 205,700 | 9/1966 | Hare, Jr. | 132/147 UX |
| D. 206,476 | 12/1966 | Cournoyor | 132/149 UX |
| 2,191,254 | 2/1940 | Harmon | 432/147 |
| 2,438,945 | 4/1948 | Rhodes | 132/149 |
| 2,605,773 | 8/1952 | Auclair | 132/11 R |

*Primary Examiner*—Gregory E. McNeill

*Attorney, Agent, or Firm*—Christensen, O'Connor, Johnson & Kindness

[57] ABSTRACT

A hair comb sized similar to a credit card and structured to meet the flexure requirements of being housed in a wallet or credit card holder is disclosed. The comb is formed of a thin, relatively rigid, but slightly flexible, rectangular sheet of plastic having teeth located along one edge. The length of the teeth near the ends of the comb decreases, while the tips of the teeth are maintained in alignment. Changing the length of the end teeth in this manner, plus the inclusion of relatively wider teeth and fairing areas between the teeth to significantly increase the strength of the teeth, reduces the possibility of teeth breakage. The faces of the side of the hair comb, opposite to the side from which the teeth project, includes opposed tactilely textured depressions that assist a user in removing the comb from a wallet or credit card holder.

4 Claims, 3 Drawing Figures

Fig. 1.
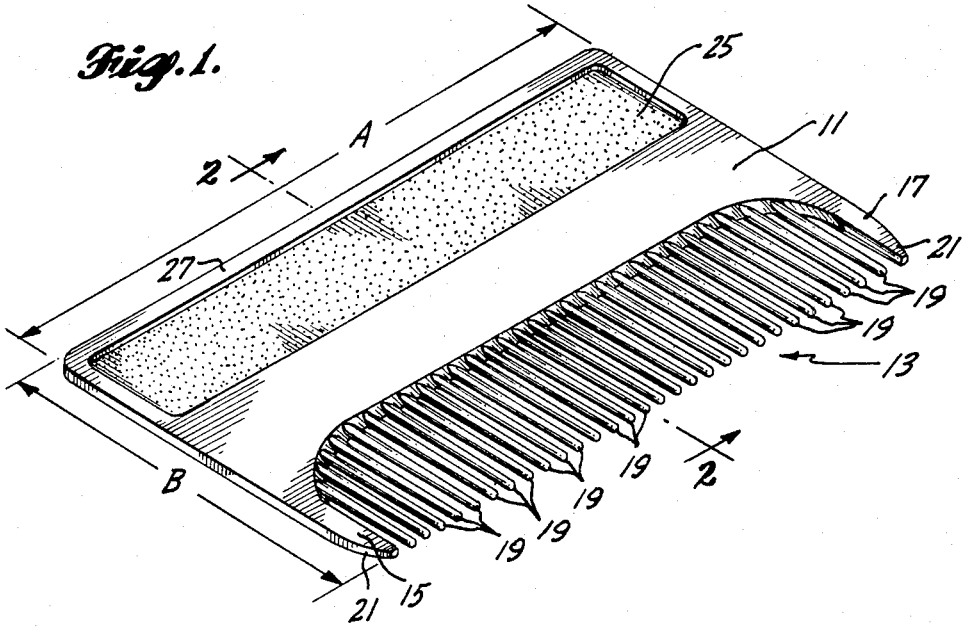
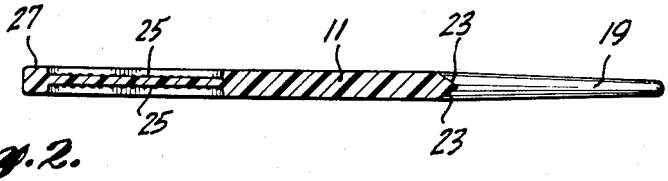
Fig. 2.
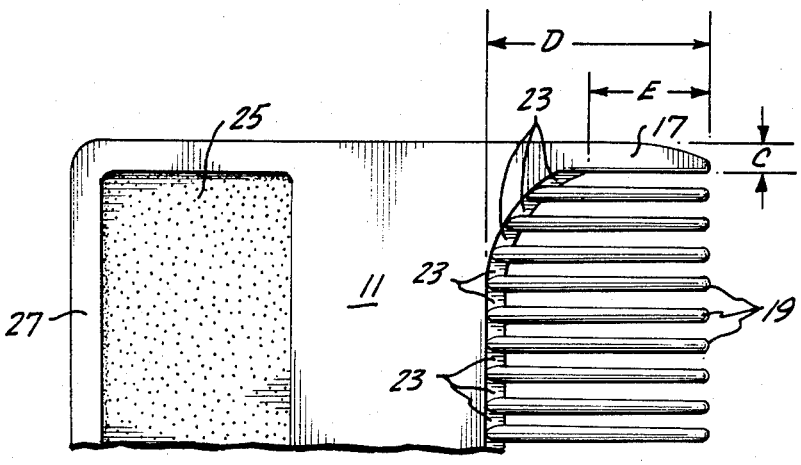
Fig. 3.

CREDIT CARD HAIR COMB

TECHNICAL AREA

This invention relates to grooming aids and, more particularly, to hair combs.

BACKGROUND OF THE INVENTION

At present, a wide variety of hair comb shapes and sizes are manufactured and offered for sale. One form of hair comb, sold primarily to men, is sized for carrying in a pocket. Such pocket combs have certain disadvantages. For example, they are subject to frequent breakage and loss. Breakage occurs because the unprotected combs are carried by men in pockets, such as the hip pocket, that allow undesirably high stresses to be applied to the comb, such as when the user sits in a chair. Frequently, teeth become broken away from the back of the comb. Alternatively, the back of the comb is broken. The present invention is directed to providing a replacement for such combs which avoids this and other disadvantages of prior art pocket combs.

One of the modern conveniences widely carried by both men and women is the credit card. Modern day wallets have been structured to carry a large number (6–12 or more) credit cards. In addition to wallets, special credit card holders are manufactured and offered for sale. The present invention is directed to providing a credit card sized comb suitable for carrying in a wallet or credit card holder. Because wallets and credit card holders protect credit cards from breakage by overlapping and/or stacking credit cards, similar protection is given to a credit card sized hair comb.

Obviously, merely making orthogonal incisions along one edge to create a plurality of teeth will not create a satisfactory comb because the thin plastic utilized to form credit cards is relatively weak. More specifically, because credit cards are formed of thin plastic the joints where the teeth and the main portion of such a comb meet will be weak, particularly teeth joints located near the end of the comb. The invention is directed to overcoming this disadvantage, plus providing a mechanism for assisting the removal of a credit card comb from a wallet or credit card holder.

SUMMARY OF THE INVENTION

In accordance with this invention a hair comb sized similar to a credit card and structured to meet the flexure requirements of being housed in a wallet or credit card holder is provided. The comb is formed of a thin, relatively rigid but slightly flexible, rectangular sheet of material (preferably plastic) having teeth located along one edge. In accordance with the invention, the potential of teeth breakage, particularly end teeth breakage, is decreased by decreasing the length of the teeth near the ends of the comb. While the length of the teeth is decreased, the tips of the teeth remain aligned. Preferably, this is accomplished by decreasing teeth length such that the profile of the joints between the end teeth and the main body of the comb appears curved.

In accordance with further aspects of this invention, the faces of the side of the credit card hair comb opposite the side in which the teeth are formed, includes opposed depressions. The opposed depressions create an edge ridge that assists a user in removing the comb from a wallet or credit card holder. Preferably, the bottoms of the depressions are tactilely textured to further assist the user in gripping the comb, particularly during removal of the comb from a wallet or credit card holder.

In accordance with still further aspects of the invention, in addition to decreasing the potential of teeth breakage by decreasing the length of the teeth near the ends of the comb, teeth breakage potential is further reduced by including relatively wider end teeth and fairing the regions between the teeth to avoid (or reduce) sharp discontinuities between the teeth and the main body of the comb.

As will be readily appreciated from the foregoing description, the invention provides a credit card sized hair comb. Because the comb is credit card sized, it is suitable for carrying in a wallet or credit card holder in the same manner that a credit card is carried in such containers. When carried in such a container, the comb is protected from breakage in the same manner that a credit card is protected by surrounding credit cards and the thickness and construction of a wallet or credit holder. Decreasing the length of the end teeth reduces the possibility of teeth breakage, particularly when the credit card comb is carried in a wallet or credit card holder. Further, the inclusion of a tactilely textured depression region along the side of the credit card remote from the side from which teeth project makes removal of the comb from a wallet or credit card holder much easier than is the case with a comb without such a depression region.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIG. 1 is an enlarged, perspective view of a credit card hair comb formed in accordance with the invention;

FIG. 2 is a further enlarged cross-sectional view along line 2—2 of FIG. 1; and, FIG. 3 is an enlarged, partial, plan view of a credit card comb formed in accordance with the invention.

DESCRIPTION OF THE PREFERRED EMBODIMENT

FIG. 1 is an enlarged perspective view of a preferred embodiment of the invention. As illustrated, a credit card hair comb formed in accordance with the invention comprises a body 11 formed of a flat rectangular sheet of a suitably strong plastic material, such as a polyamide, polycarbonate, acetate polymer or polyproplylene plastic material, for examples. Preferably, the thickness of the body 11 lies in the range of from 0.080 to 0.085 inches. The length and width dimensions, denoted A and B, respectively, are similar to the length and width dimensions of a credit card. For example, the A dimension may be 3.375 inches and the B dimension may be 2.125 inches.

Located along one of the long edges of the body 11 are a plurality of teeth 13. The teeth include a pair of end teeth 15 and 17 and a plurality of intermediate teeth 19. The width of the end teeth 15 and 17 is significantly greater than the width of the intermediate teeth 19. For example, in one actual embodiment of the invention, the overall width of the end teeth (dimension C, FIG. 3) was 0.1175 inches. The width of the intermediate teeth was 0.06 inches and the distance between the teeth was 0.04 inches.

As also illustrated in FIGS. 1 and 3, preferably, the outer edge 21 of the end teeth 15 and 17 near the outer tip thereof curve inwardly, toward the other teeth. As illustrated in FIGS. 1–3 the tips of all of the teeth, including the end teeth 15 and 17 and the intermediate teeth 19, are smooth and rounded in all directions.

As illustrated in FIGS. 1 and 3, the length of the intermediate teeth 19 near the end teeth 15 and 17 decreases such that the profile of the joints between the teeth and the body 11 of the comb is curved. In one actual embodiment of the invention, the length of the teeth 19 in the center area of the comb (dimension D in FIG. 3) were 0.75 inches; and, the length of the end teeth 15 and 17 (dimension E in FIG. 3) was 0.4 inches. The three teeth located immediately inwardly of the end teeth 15 and 17 were shorter than the more inward teeth 19 and longer than the end teeth 15. The dimensional difference was such that the joints between the three denoted teeth and the body of the comb created the profile of a curve. As with a conventional comb, the joint regions 23 located between the body 11 of the comb and the teeth 15, 17 and 19 are faired in order to reduce discontinuities and provide additional support for the teeth.

As will be readily appreciated by those familiar with stresses in plastic, varying the length of the comb teeth in the manner illustrated in the drawings and described above reduces the potential of teeth breakage. The potential is reduced because the shorter teeth create a shorter lever arm and, thus, less joint breaking force for a fixed amount of tip force. Teeth breakage potential is further reduced by the inclusion of larger end teeth 15 and 17 and fairing regions 23 at the joints between the teeth and the body 11 of the comb.

Located near the edge of the body 11 opposite the edge containing the teeth 13 are opposed depression regions 25. The opposed depression regions 25 create a ridge 27 along the edge of the comb opposite the edge containing the teeth 13. While various dimensions can be used, preferably, the depressions 25 are such that an approximately 0.1875 inch wide ridge 27 is formed along the edge of the body 11. In one actual embodiment of the invention, the depressions were recessed by 0.02 inches and were approximately 0.625 inches wide. Preferably, the floor of the depressions are tactilely textured.

As will be readily appreciated by those familiar with credit cards, in some instances it is difficult to remove a credit card from a wallet or credit card holder, particularly when the surface of the credit card is slick. The inclusion of depressions 25 forming a ridge 27 reduces this problem, particularly when the bottoms of the depressions are tactilely textured. More specifically, the ridge 27 in combination with the depressions 25 creates a finger gripping area that allows a credit card comb formed in accordance with the invention to be easily removed from a wallet or credit card holder.

In summary, the invention comprises a hair comb having a length, width and thickness dimensions approximating the length, width and thickness dimensions of a conventional credit card. Teeth are located along one end of the credit card comb. The length of the teeth decreases as the end of the teeth is approached to reduce the potential of teeth breakage. Further, the end teeth are wider than the inner teeth to further reduce the possibility of teeth breakage, particularly end teeth breakage. While wider, the tips of the end teeth taper inwardly along their outer edges to make the insertion and removal of the comb from a wallet or credit card holder easier. Finally, the credit card comb includes a depression region that creates a ridge that allows a user to better grip the comb during removal from a wallet or credit card holder.

While a preferred embodiment of the invention has been illustrated and described, it will be appreciated that various changes can be made therein without departing from the spirit and scope of the invention. For example, rather than being curved, the profile of the change in length of the teeth near the ends of the comb could change lineally, if desired. In addition, the comb material could be metal, such as an aluminum alloy, rather than plastic, if desired. Further, various of the dimensions set forth above can be changed without departing from the spirit and scope of the invention. Consequently, the invention can be practiced otherwise than as specifically described herein.

The embodiments of the invention in which an exclusive property or privilege is claimed are defined as follows:

1. A credit card hair comb comprising:

a thin, rectangular sheet of relatively rigid, but slightly flexible material having length, width and thickness dimensions substantially the same as the length, width and thickness dimensions of a credit card;

a plurality of teeth located along one of the edges of said thin, rectangular sheet of material, the end teeth of said plurality of teeth being substantially wider than the other teeth of said plurality of teeth and the length of said teeth near the ends of said plurality of teeth decreasing, said decrease in length being such that the profile of the joints between the teeth and the body of said thin, rectangular sheet of material is curved near the ends of said plurality of teeth;

fairing regions formed at the joints between the teeth and the body of said thin, rectangular sheet of material for reducing discontinuities and strengthening said joints; and, removal assistance means located along the edge of said thin, rectangular sheet of material opposite the edge along which said teeth are located; said removable assistance means comprising a first rectangular depression of substantially constant depth having a tactilely textured bottom located on one side of said thin, rectangular sheet of material along the edge of said thin, rectangular sheet opposite the edge along which said teeth are located and a second rectangular depression of substantially constant depth having a tactilely textured bottom located on the other side of said thin, rectangular sheet of material along the edge of said thin, rectangular sheet opposite the edge along which said teeth are located, said second rectangular depression being aligned with said first rectangular depression and sized the same as said first rectangular depression, said first and second rectangular depressions creating a ridge along the edge of said thin, rectangular sheet of material opposite the edge along which said teeth are located.

2. A credit card comb as claimed in claim 1 wherein said length and width dimensions of said thin, rectangular sheet of material are approximately 3.375 inches and 2.125 inches, respectively.

3. A credit card hair comb as claimed in claim 1 wherein said thin, rectangular sheet of material is a thin, rectangular sheet of plastic material.

4. A credit card hair comb as claimed in claim 3 wherein said length and width dimensions of said thin, rectangular sheet of material are approximately 3.375 inches and 2.125 inches, respectively.

* * * * *